US008898816B2

(12) United States Patent
Highfield

(10) Patent No.: US 8,898,816 B2
(45) Date of Patent: Dec. 2, 2014

(54) WOMEN'S SPORTS TOP WITH INTEGRATED POCKET ASSEMBLY

(76) Inventor: Kimberly K. Highfield, Charlotte, NC (US)

( * ) Notice: Subject to any disclaimer, the term of this patent is extended or adjusted under 35 U.S.C. 154(b) by 254 days.

(21) Appl. No.: 13/134,274

(22) Filed: Jun. 3, 2011

(65) Prior Publication Data

US 2012/0304357 A1 Dec. 6, 2012

(51) Int. Cl.

| | |
|---|---|
| ***A41D 27/20*** | (2006.01) |
| ***A41D 1/00*** | (2006.01) |
| ***A41D 13/05*** | (2006.01) |

(52) U.S. Cl.

CPC ..... *A41D 1/002* (2013.01); *A41D 13/0518* (2013.01); *A41D 27/205* (2013.01)

USPC ..... 2/248; 2/247; 2/272

(58) Field of Classification Search

USPC ..... 2/69, 247, 272, 905, 113, 248, 114, 2/115; 206/320, 719, 720, 38; 450/89

See application file for complete search history.

(56) References Cited

U.S. PATENT DOCUMENTS

| | | | | | |
|---|---|---|---|---|---|
| 308,244 | A | * | 11/1884 | Fishel | 2/115 |
| 2,436,430 | A | * | 2/1948 | Hart | 450/3 |
| 2,503,847 | A | * | 4/1950 | Shanahan | 450/89 |
| 2,624,881 | A | * | 1/1953 | Dunson | 450/89 |
| 2,688,752 | A | * | 9/1954 | Sbarra et al. | 2/113 |
| 3,628,192 | A | * | 12/1971 | Artz, Sr. | 2/130 |
| 4,825,471 | A | * | 5/1989 | Jennings | 2/94 |
| 4,980,564 | A | | 12/1990 | Steelmon | |
| 5,103,504 | A | * | 4/1992 | Dordevic | 2/243.1 |
| D408,963 | S | * | 5/1999 | Consolo | D2/706 |
| 6,099,382 | A | * | 8/2000 | Wilson | 450/89 |
| 6,176,761 | B1 | * | 1/2001 | Underhill | 450/89 |
| D448,541 | S | * | 10/2001 | Robinson | D2/706 |
| 6,517,410 | B1 | * | 2/2003 | Underhill | 450/1 |
| 6,626,733 | B1 | * | 9/2003 | Knutson | 450/89 |
| 6,986,164 | B1 | * | 1/2006 | Morales | 2/94 |
| D522,717 | S | * | 6/2006 | Aurilia et al. | D2/706 |
| 7,364,491 | B2 | * | 4/2008 | Updyke | 450/89 |
| 7,753,759 | B2 | * | 7/2010 | Pintor et al. | 450/89 |
| 2002/0100108 | A1 | * | 8/2002 | Stuart | 2/247 |
| 2003/0192102 | A1 | * | 10/2003 | Marmaropoulos et al. | 2/69 |
| 2005/0112976 | A1 | * | 5/2005 | McMurray et al. | 442/306 |
| 2005/0235398 | A1 | * | 10/2005 | Yoo | 2/247 |
| 2005/0246823 | A1 | * | 11/2005 | Groom | 2/247 |
| 2006/0075537 | A1 | * | 4/2006 | Tsai | 2/69 |
| 2006/0206990 | A1 | * | 9/2006 | Demus | 2/247 |
| 2007/0245444 | A1 | * | 10/2007 | Brink | 2/69 |
| 2008/0032600 | A1 | * | 2/2008 | Updyke | 450/89 |

(Continued)

OTHER PUBLICATIONS

SwissShield® Wear™ RF Shielding Fabrics; www.lessemf.com; internet advertisement by LES EMF Inc.; published prior to Jun. 3, 2011; 1 pg.

(Continued)

*Primary Examiner* — Andrew W Collins

(74) *Attorney, Agent, or Firm* — Schwartz Law Firm, P.C.

(57) ABSTRACT

A garment top includes a body fabric designed for covering a chest of a wearer, and a pocket assembly formed with the body fabric. The pocket assembly comprises a front and a back cooperating to form a pocket for holding an article proximate the chest of the wearer. The back of the pocket assembly incorporates a radiation barrier adapted for residing between the article and the wearer.

10 Claims, 2 Drawing Sheets

(56) References Cited

U.S. PATENT DOCUMENTS

| | | | | |
|---|---|---|---|---|
| 2009/0094725 | A1* | 4/2009 | Smith et al. | 2/69 |
| 2009/0104845 | A1* | 4/2009 | Pintor et al. | 450/31 |
| 2009/0158494 | A1* | 6/2009 | McMullen | 2/102 |
| 2009/0235426 | A1* | 9/2009 | Johnston et al. | 2/84 |
| 2009/0320183 | A1* | 12/2009 | Riney | 2/250 |
| 2011/0058705 | A1* | 3/2011 | Lee et al. | 381/388 |
| 2011/0145969 | A1* | 6/2011 | Witten et al. | 2/69 |
| 2011/0214219 | A1* | 9/2011 | Miller | 2/115 |
| 2011/0277206 | A1* | 11/2011 | Sokolowski | 2/69 |
| 2011/0307991 | A1* | 12/2011 | Writt | 2/69 |
| 2012/0047631 | A1* | 3/2012 | Connolly | 2/272 |

OTHER PUBLICATIONS

Soft&Safe™ Shielding Fabric—The Perfect Garment Shield; www.lessemf.com; internet advertisement by LES EMF Inc.; published prior to Jun. 3, 2011; 1 pg.

* cited by examiner

WOMEN'S SPORTS TOP WITH INTEGRATED POCKET ASSEMBLY

TECHNICAL FIELD AND BACKGROUND OF THE INVENTION

This invention relates broadly and generally a multiple layer fabric composite and pocket assembly incorporating a multiple layer fabric composite. In exemplary embodiments, the present pocket assembly may be integrated in a women's sports top (or other men's or women's garments) for holding a mobile phone or other handheld electronic device.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a garment top including a body fabric designed for covering a chest of a wearer, and a pocket assembly formed with the body fabric. The pocket assembly comprises a front and a back cooperating to form a pocket for holding an article proximate the chest of the wearer. The back of the pocket assembly incorporates a radiation barrier adapted for residing between the article and the wearer.

The term "chest" refers broadly herein to all or any part of the body between the neck and the abdomen.

According to another exemplary embodiment, the front and back of the pocket assembly define a pocket opening adjacent a front neckline of the garment top.

According to another exemplary embodiment, the body fabric is vertically split at the neckline of the garment top adjacent the pocket opening of the pocket assembly.

According to another exemplary embodiment, a zipper closure is provided for selectively closing the vertically split body fabric at the neckline of the garment top.

According to another exemplary embodiment, the front of the pocket assembly comprises a see-through fabric layer. The term "see-through fabric" refers generally to any fabric which incorporates an open mesh knit, woven or knotted structure, lace, or sheer material sufficient to allow the display screen of a mobile phone to be seen through the fabric while the phone is carried in the pocket.

According to another exemplary embodiment, the see-through fabric layer comprises an open mesh structure.

According to another exemplary embodiment, the back of the pocket assembly further comprises a moisture barrier.

According to another exemplary embodiment, the back the pocket assembly further comprises a skin-side liner.

According to another exemplary embodiment, the skin-side liner comprises a moisture wicking micro-denier polyester.

In another exemplary embodiment, the present disclosure comprises a pocket assembly adapted for being integrally formed with a garment.

In yet another exemplary embodiment, the present disclosure comprises the combination of a mobile phone and garment top.

BRIEF DESCRIPTION OF THE DRAWINGS

Exemplary embodiments of the present invention will hereinafter be described in conjunction with the following drawing figures, wherein like numerals denote like elements, and wherein:

FIG. 1A is an enlarged view of the front neckline and pocket assembly shown in FIG. 1;

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
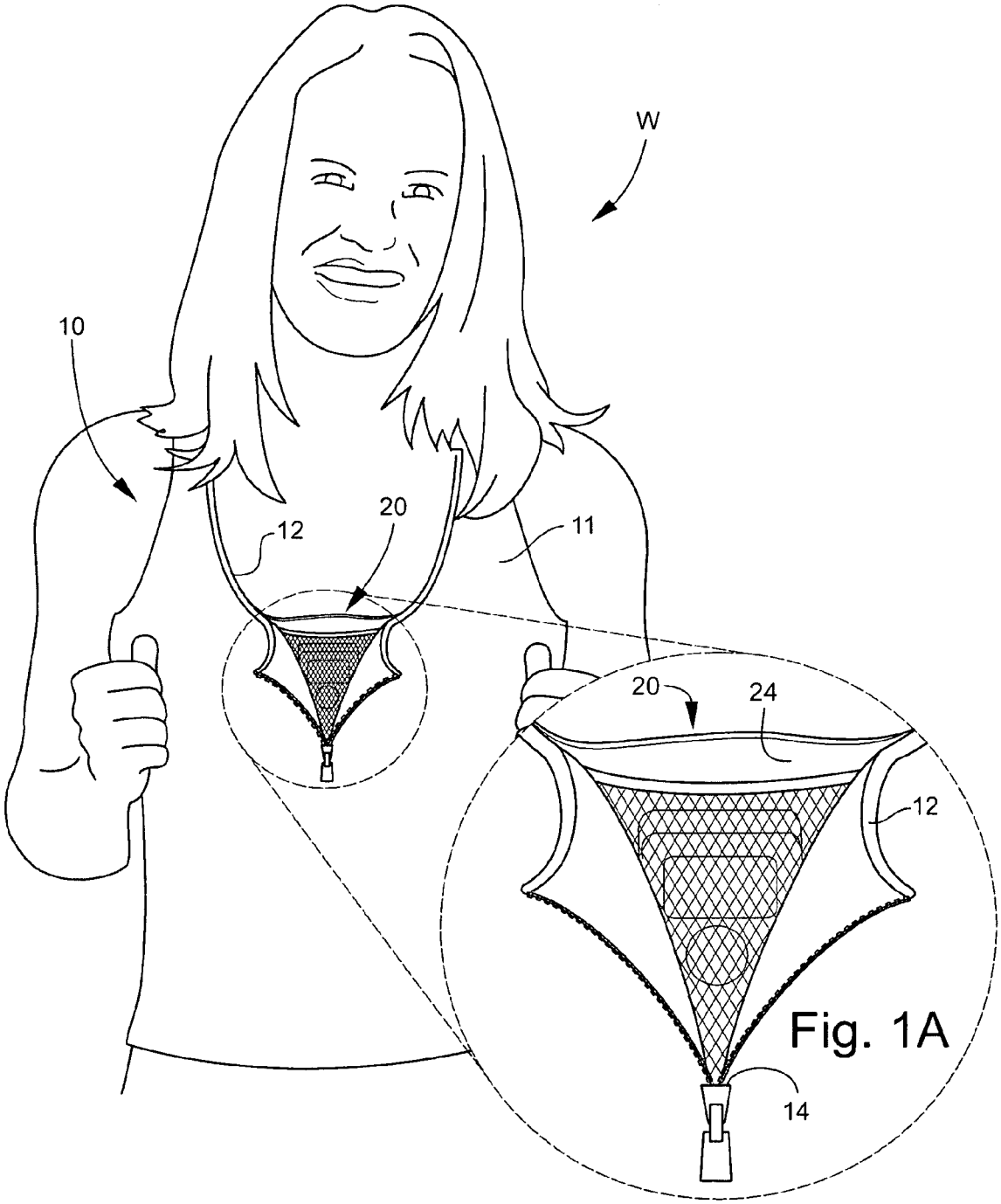
FIG. 1 illustrates a women's sports top incorporating a mobile phone pocket assembly according to one exemplary embodiment of the present disclosure.

Referring now specifically to the drawings, a women's sports top according to one exemplary embodiment of the present disclosure is illustrated in FIGS. 1 and 1A, and shown generally at reference numeral 10. The exemplary sports top 10 is constructed of a conventional stretch body fabric 11 comprising spandex or other elastic yarns, and defines openings for the arms, head, and torso of the wearer "W". In the embodiment shown, the body fabric 11 is vertically center split at the front neckline 12, and has a zipper closure 14 for selectively opening and closing the neckline 12.

Figure 3:
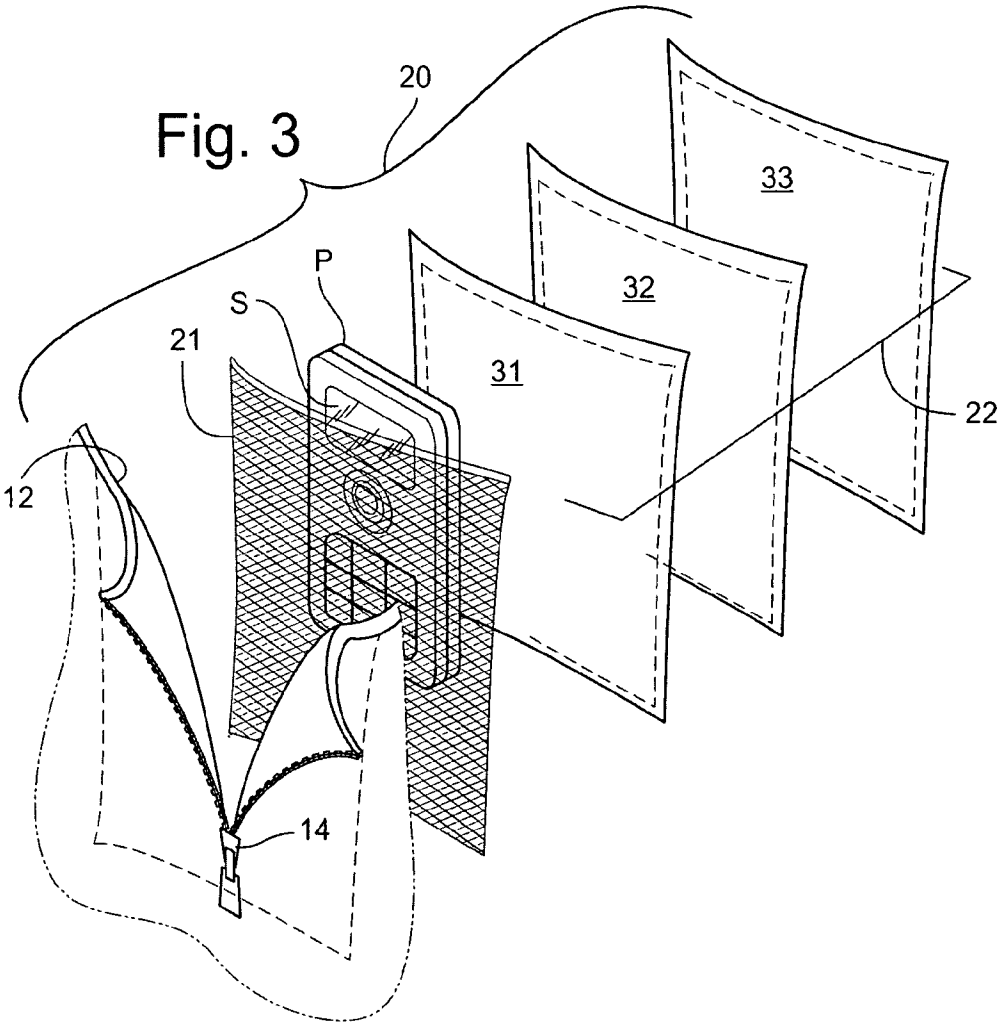
FIG. 3 is an exploded view of the pocket assembly.
Figure 2:
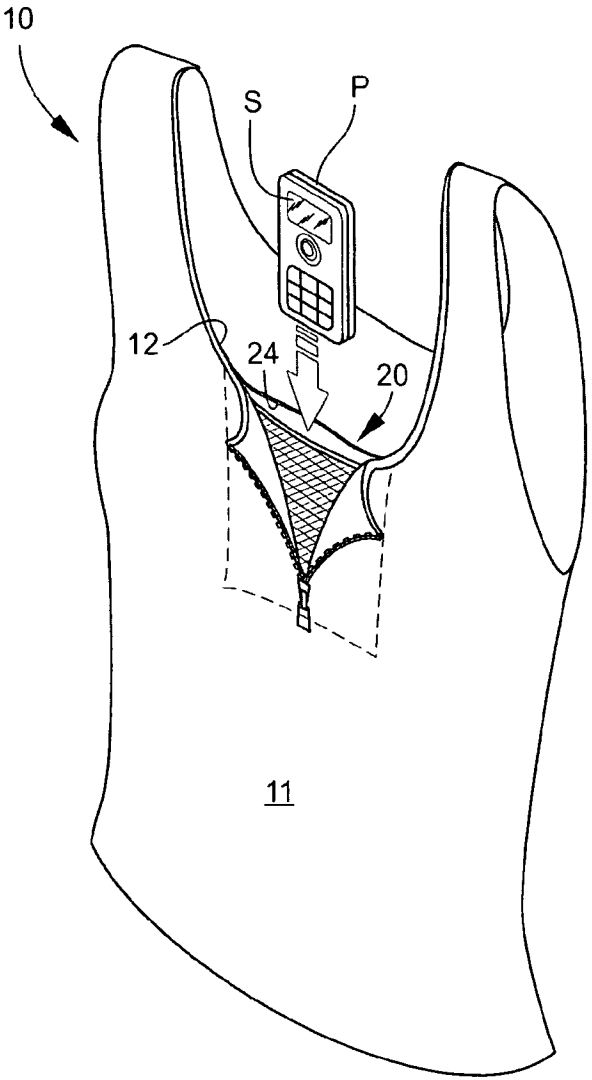
FIG. 2 is a perspective view of the sports top demonstrating insertion of the mobile phone in the pocket assembly.

As best shown in FIGS. 1A, 2, and 3, an exemplary pocket assembly 20 is integrally formed with the body fabric 11 adjacent the center split neckline 12, and resides substantially inside the sports top 10 between the body fabric 11 and wearer "W". The pocket assembly 20 comprises a fabric front 21 and multi-layer back 22. The front and back 21, 22 are joined together and to the body fabric 11 (e.g., by sewing) along respective side and end edges, and cooperate to form a pocket therebetween designed for receiving and holding a mobile phone "P". The top of the pocket assembly 20 runs along substantially the same line as the front neckline 12, and defines a pocket opening 24 through which the phone "P" is inserted and removed from the pocket (as demonstrated in FIG. 2).

The multi-layer back 22 of the pocket assembly 20 comprises a moisture barrier 31, radiation barrier 32, and skin-side liner 33; all overlying and joined together along respective top, side, and bottom edges to form a unitary composite backing. The exemplary moisture barrier 31 may comprise a breathable, substantially moisture impermeable fabric, such as that sold under the brand name Crypton® Super Fabric by Hi-Tex, Inc. of West Bloomfield, Mich. This fabric is described in detail in prior U.S. Pat. No. 7,531,219; the complete disclosure of which is incorporated herein by reference. The radiation barrier 32 may comprise an RF shielding fabric, such as that manufactured by Less EMF Inc., and sold under the brand name SwissShield®. This fabric incorporates tightly woven thin silver coated copper wires spun with cotton yarns. The fabric is washable, comfortable, and durable. Attenuation data comprises 29 dB at 900 MHz. An alternative radiation barrier fabric is described in prior U.S. Pat. No. 4,980,564; the complete disclosure of which is incorporated herein by reference. The skin-side liner 33 of the pocket back 22 may comprise any comfort or moisture wicking fabric, such as fleece, suitable for drawing sweat and perspiration off of the skin and moving it outwardly towards the outside edges of the pocket assembly. Commercial examples of moisture wicking fabrics include CoolBalance® by Cool Sets, Inc. of Evergreen, Colo., and PowderDry™ by Malden Mills. The PowerDry™ fabric is 100% microfiber polyester, and is promoted as having excellent breathability and stretch.

The front 21 of the pocket assembly 20 is joined to the multi-layer back 22 along respective side and end edges, as indicated above, and the composite pocket assembly 20 then joined along its side and end edges to the body fabric 11. The pocket assembly 20 bridges (and spans) the V-shaped opening defined by the split neckline 12 of the sports top 10, and may provide increased garment support, comfort and performance.

When carried in the pocket assembly 20, the mobile phone "P" is held safely against the chest of the wearer and may be oriented such that its microphone and/or speaker locate proximate the pocket opening 24, and are usable and effective. The exemplary front 21 of the pocket assembly 20 may comprise a see-through fabric, such as an open mesh knit, which allows the wearer to readily and conveniently view the display screen "S" of the mobile phone "P" to check incoming calls without first removing the phone "P" from the pocket.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A garment top, comprising:

a body fabric designed for covering a chest of a wearer;

a pocket assembly formed with said body fabric, and comprising a front and a back;

said front and back cooperating to form a pocket for holding a radiation-emitting article proximate the chest of the wearer, said pocket comprising a top opening adjacent to and substantially coextensive with a front neckline of said garment top, and said body fabric defining a vertical split extending downward from the front neckline of said garment top and over the front of said pocket assembly; and the back of said pocket assembly comprising a radiation barrier material adapted for residing between the radiation-emitting article and the wearer, and wherein the front of said pocket assembly and an area of said body fabric outside of said pocket assembly are substantially free of said radiation barrier material.

2. The garment top according to claim 1, and comprising a zipper closure for selectively closing the vertical split at the neckline of said garment top.

3. The garment top according to claim 1, wherein the front of said pocket assembly comprises a see-through fabric layer.

4. The garment top according to claim 3, wherein said see-through fabric layer comprises an open mesh structure.

5. The garment top according to claim 1, wherein the back of said pocket assembly further comprises a moisture barrier.

6. The garment top according to claim 1, wherein the back said pocket assembly further comprises a skin-side liner.

7. The garment top according to claim 6, wherein said skin-side liner comprises a moisture wicking micro-denier polyester.

8. In combination with a mobile phone, a garment top comprising:

a body fabric designed for covering a chest of a wearer;

a pocket assembly formed with said body fabric, and comprising a front and a back;

said front and back cooperating to form a pocket for holding said phone proximate the chest of the wearer, said pocket comprising a top opening adjacent to and substantially coextensive with a front neckline of said garment top, and said body fabric defining a vertical split extending downwardly from the front neckline of said garment top and over the front of said pocket assembly; and the back of said pocket assembly comprising a radiation barrier adapted for residing between said phone and the wearer, and wherein the front of said pocket assembly and an area of said body fabric outside of said pocket assembly are substantially free of said radiation barrier material.

9. The combination according to claim 8, wherein the front of said pocket assembly comprises a see-through fabric layer.

10. The combination according to claim 8, wherein the back of said pocket assembly further comprises a moisture barrier.

* * * * *